US005960786A

United States Patent [19]

Lambertson

[11] Patent Number: 5,960,786

[45] Date of Patent: Oct. 5, 1999

[54] ADJUSTABLE CARTRIDGE FILTER FOR CARTRIDGE VENTILATOR

[75] Inventor: Jeffrey S. Lambertson, Millbrae, Calif.

[73] Assignee: Gemini Steel, Inc., Hayward, Calif.

[21] Appl. No.: 09/003,547

[22] Filed: Jan. 6, 1998

[51] Int. Cl.[6] ..... F24C 15/20

[52] U.S. Cl. ..... 126/299 D; 126/299 R

[58] Field of Search ..... 454/56, 61, 67; 126/299 D, 299 R

[56] References Cited

U.S. PATENT DOCUMENTS

| | | | |
|---|---|---|---|
| 3,530,784 | 9/1970 | Courchesne . | |
| 4,011,802 | 3/1977 | Molitor et al. | 98/115 K |
| 4,072,143 | 2/1978 | Gaylord . | |
| 4,155,348 | 5/1979 | Ahlrich . | |
| 4,200,087 | 4/1980 | Welsh . | |
| 4,281,635 | 8/1981 | Gaylord | 126/299 D |
| 4,373,509 | 2/1983 | Neitzel et al. . | |
| 5,042,457 | 8/1991 | Gallagher | 126/299 E |
| 5,251,608 | 10/1993 | Cote | 126/299 D |
| 5,271,377 | 12/1993 | Rouleau . | |
| 5,394,861 | 3/1995 | Stegmaier . | |
| 5,429,116 | 7/1995 | Brown . | |
| 5,522,377 | 6/1996 | Fritz | 126/299 R |
| 5,540,214 | 7/1996 | Boudreault | 126/299 E |
| 5,718,219 | 2/1998 | Boudreault | 126/299 E |
| 5,738,083 | 4/1998 | Pettinari | 126/299 D |

FOREIGN PATENT DOCUMENTS 63-183324 7/1988 Japan .

*Primary Examiner*—Harold Joyce
*Assistant Examiner*—Derek S. Boles
*Attorney, Agent, or Firm*—Townsend and Townsend and Crew LLP

[57] ABSTRACT

An adjustable cartridge filter for use in a cartridge ventilator hood comprises a filter housing including a front wall having a front wall opening and a back wall spaced from the front wall and having a back wall opening. A flow diverter is disposed obstructively at the back wall opening and extends between the front wall and the back wall, causing a flow restriction between the front wall opening and the back wall opening. The flow diverter is adjustable with respect to the front wall and back wall to change the amounts of the resistance generated by the cartridge and the size of the air passage through the cartridge filter. A rear choke portion may be placed about the housing to be adjustably spaced from the back wall and back wall opening to further control flow resistance.

23 Claims, 7 Drawing Sheets

ADJUSTABLE CARTRIDGE FILTER FOR CARTRIDGE VENTILATOR

BACKGROUND OF THE INVENTION

In a typical restaurant kitchen, a plurality of cooking units are lined up side by side in a row under a common exhaust hood. The cooking units may include, for example, ranges, griddles, fryers, and broilers. They all produce air laden with grease, smoke, fumes, moisture, and heat in varying amounts and temperatures. Low temperature cooking equipment such as ranges and griddles produce considerably less amounts of such pollutants in comparison to high temperature equipment such as broilers. Traditional ventilation apparatus are unable to adjust or regulate the airflow in segments within the filter area of the hood. Therefore, to exhaust all of the pollutants and heated air produced from the cooking equipment, traditional ventilation apparatus provide excess ventilation for cooking units such as ranges and griddles in order to capture the large quantities of pollutants produced by broilers and fryers. To increase efficiency, some have modified traditional kitchen ventilators with inlet throat choke attachments in air inlet regions associated with low-pollutant cooking units. The inlet throat choke attachments reduce or throttle the flow of air through portions of the ventilator where the maximum available rate of air removal is not required to remove the pollutants generated by the associated units. U.S. Pat. No. 4,281,635 issued Aug. 4, 1981 to Gaylord discloses one such kitchen ventilator.

The installation of the supplemental inlet throat choke attachments into an existing ventilation hood requires taking apart the ventilation apparatus. The installation, removal, and adjustment of the choke attachments are difficult and time-consuming. Further, pollutants such as grease and particulates carried by the air accumulate on the choke attachments and surrounding areas, which need to be cleaned periodically. Typical water-washed ventilation hoods employ water streams that cannot reach the different sides of the choke attachments disposed at various angles. The accumulation of the pollutants have a negative impact on the ventilation system, and create unsanitary conditions and fuel for any fire within the ventilation apparatus. In addition, because there are different types and sizes of ventilation hoods and different attachments of the cooking units, the choke attachments will typically need to be custom-designed to achieve the maximum benefits.

Some have designed exhaust hoods that are adjustable to achieve improved ventilation. For instance, U.S. Pat. No. 5,522,377 to Fritz discloses an adjustable exhaust hood that includes an open underside and a grease filter defining an exhaust plenum between the hood and the grease filter and a flow path through the grease filter. A shutter-like panel is slidable into the flow path adjacent to the grease filter for blocking a portion of the flow path to adjust a volume of air flowing through the exhaust hood. Fritz also discloses the use of multiple side-by-side panels.

SUMMARY OF THE INVENTION

The present invention provides a removable, adjustable ventilation cartridge filter for use in a cartridge ventilator to increase the efficiency of the ventilator by regulating and adjusting the air flow in segments corresponding to different associated cooking units and extracting the maximum amount of pollutants by maintaining high air speed within the cartridge. The cartridge filter has an adjustable flow diverter and choke to control the resistance and speed of the air flow through the cartridge. The cartridge filter fits easily into a track provided as part of a cartridge ventilation hood. As a result, the cartridge filter is easy to install and easy to remove for inspection, adjustment, or cleaning.

In accordance with an aspect of the present invention, an adjustable cartridge filter for use in a cartridge ventilator comprises a filter housing including a front wall having a front wall opening and a back wall coupled to and spaced from the front wall and having a back wall opening. A flow diverter is disposed obstructively at the back wall opening and is adjustably supported by the housing to move relative to the back wall and front wall. The flow diverter has a front diverter portion spaced from the front wall to define an adjustable front diverted spacing. The flow diverter has a rear choke portion coupled to the front diverter portion and blocking a portion of the back wall opening to define an adjustable rear diverted spacing. The adjustable rear diverted spacing is equal to a remaining portion of the back wall opening not blocked by the rear diverter portion.

In accordance with another aspect of the invention, an adjustable cartridge filter for use in a cartridge ventilator comprises a front wall having a front wall opening. A back wall is coupled to and spaced from the front wall by a wall spacing, and has a back wall opening with a boundary. A flow diverter includes a wall spacing adjustment portion coupled with a back wall opening adjustment portion. The cartridge filter further comprises means for movably coupling the flow diverter to the back wall to adjust the wall spacing adjustment portion relative to the front wall to change the size of the wall spacing and to adjust the back wall opening adjustment portion relative to the boundary of the back wall opening to change the size of the back wall opening.

In accordance with yet another aspect of the invention, a cartridge ventilator comprises a ventilator hood and a cartridge filter housed in the ventilator hood. The cartridge filter comprises a filter housing including a front wall having a front wall opening and a back wall coupled to and spaced from the front wall and having a back wall opening. The cartridge filter further comprises a flow diverter disposed obstructively at the back wall opening. The flow diverter has a front diverter portion spaced from the front wall to define a front diverted spacing, and a rear choke portion coupled to the front diverter and blocking a portion of the back wall opening to define a rear diverted spacing equal to a remaining portion of the back wall opening not blocked by the rear choke portion. A rear choke portion is coupled to the ventilation hood and obstructively spaced from the rear diverted spacing.

BRIEF DESCRIPTION OF THE DRAWINGS

The preferred embodiments of this invention, illustrating all their features, will now be discussed in detail. These embodiments depict the novel and nonobvious ventilation cartridge filter of this invention shown in the accompanying drawings, which are included for illustrative purposes only. These drawings include the following figures, with like numerals indicating like parts.

DETAILED DESCRIPTION OF THE INVENTION

Figure 1:
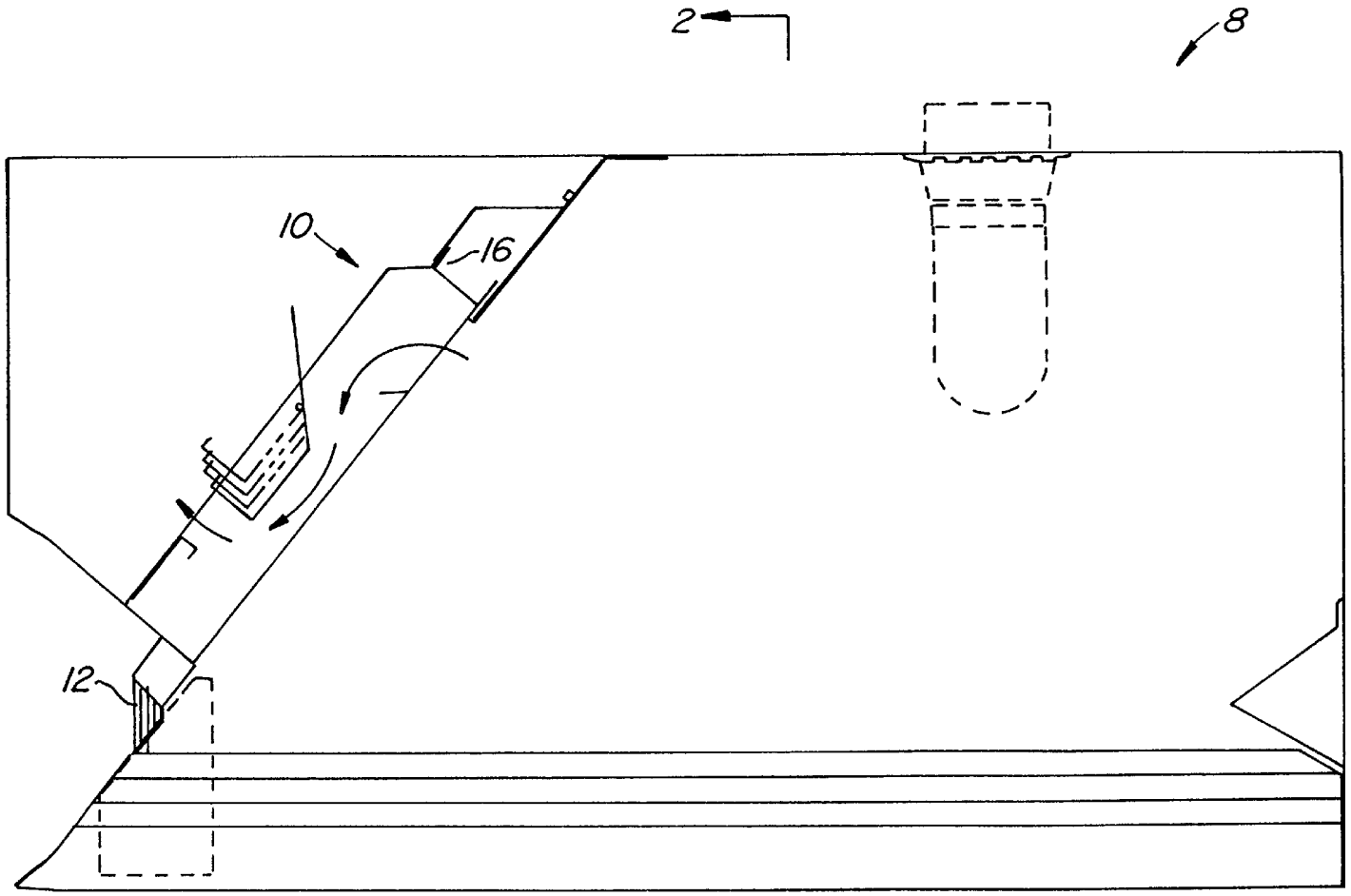
FIG. 1 is a side view of a cartridge filter installed in a cartridge ventilation hood schematically illustrating an embodiment of the present invention.
Figure 2:
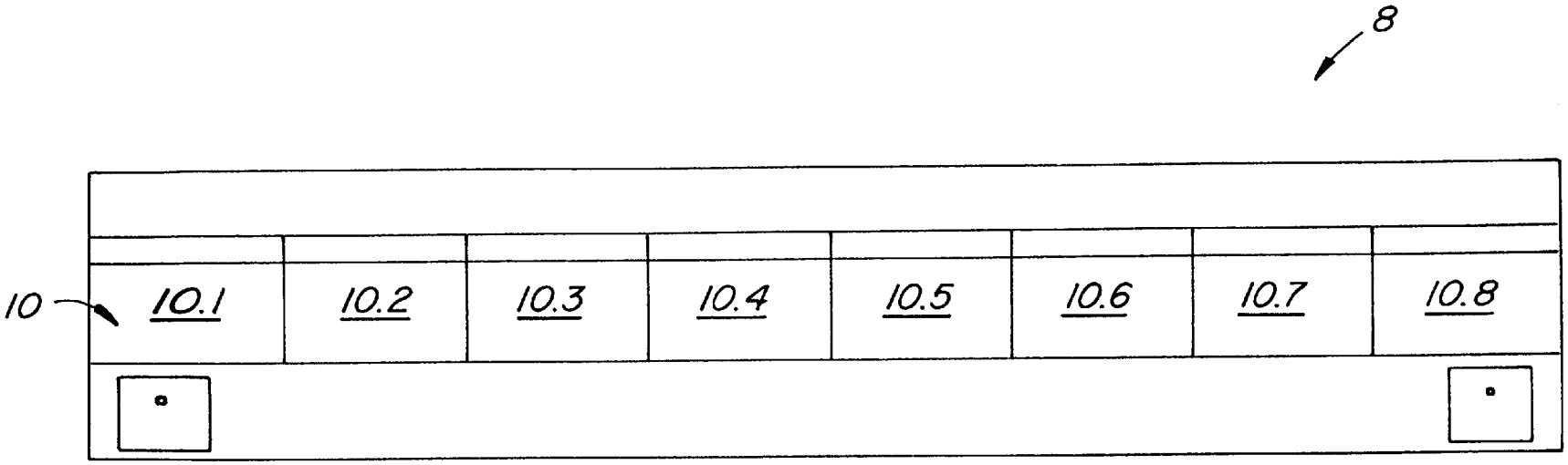
FIG. 2 is a partial cross-sectional view of the ventilation hood of FIG. 1 along A—A.
Figure 3:
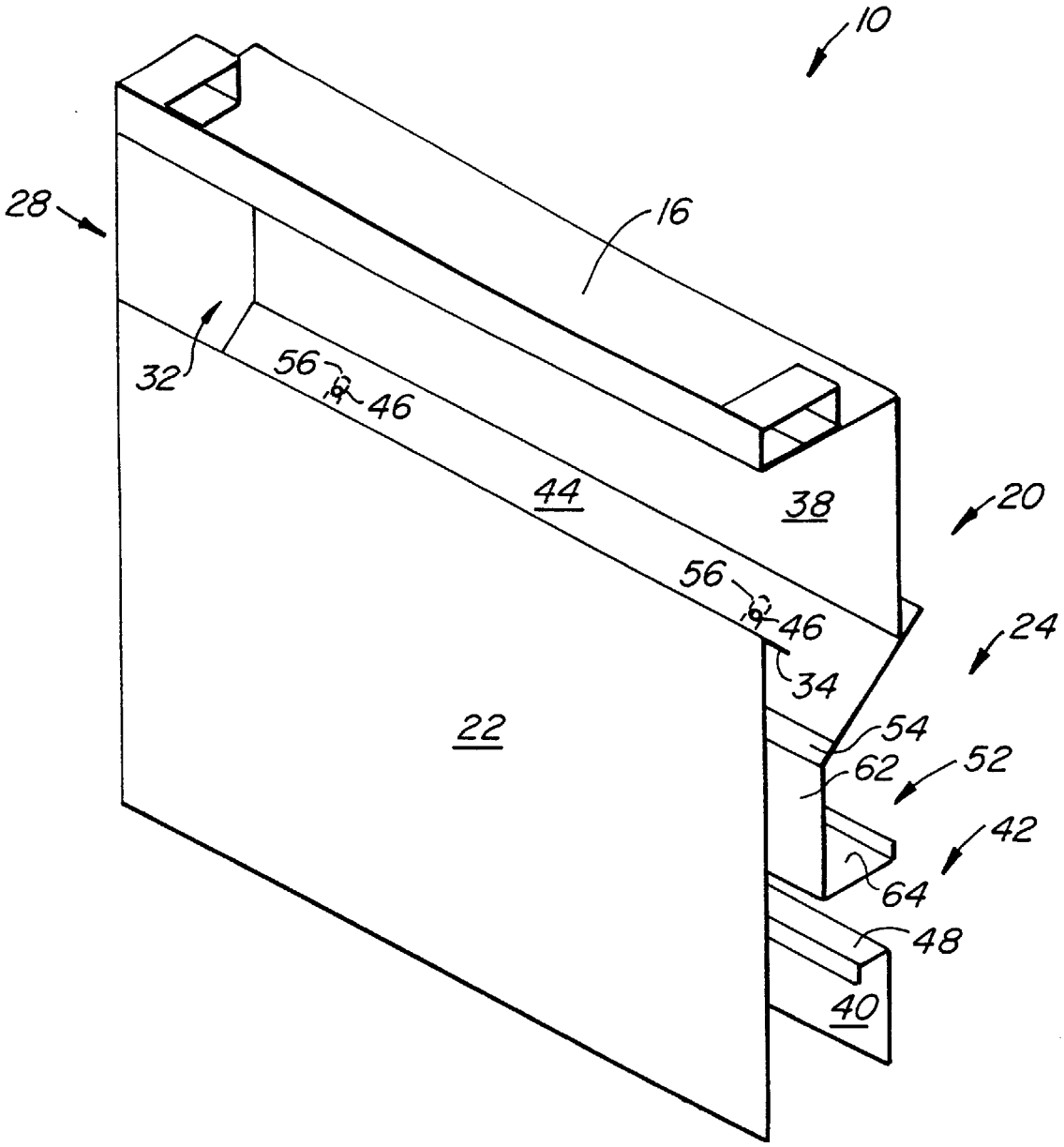
FIG. 3 is a front perspective view illustrating the cartridge filter of FIG. 1.
Figure 4:
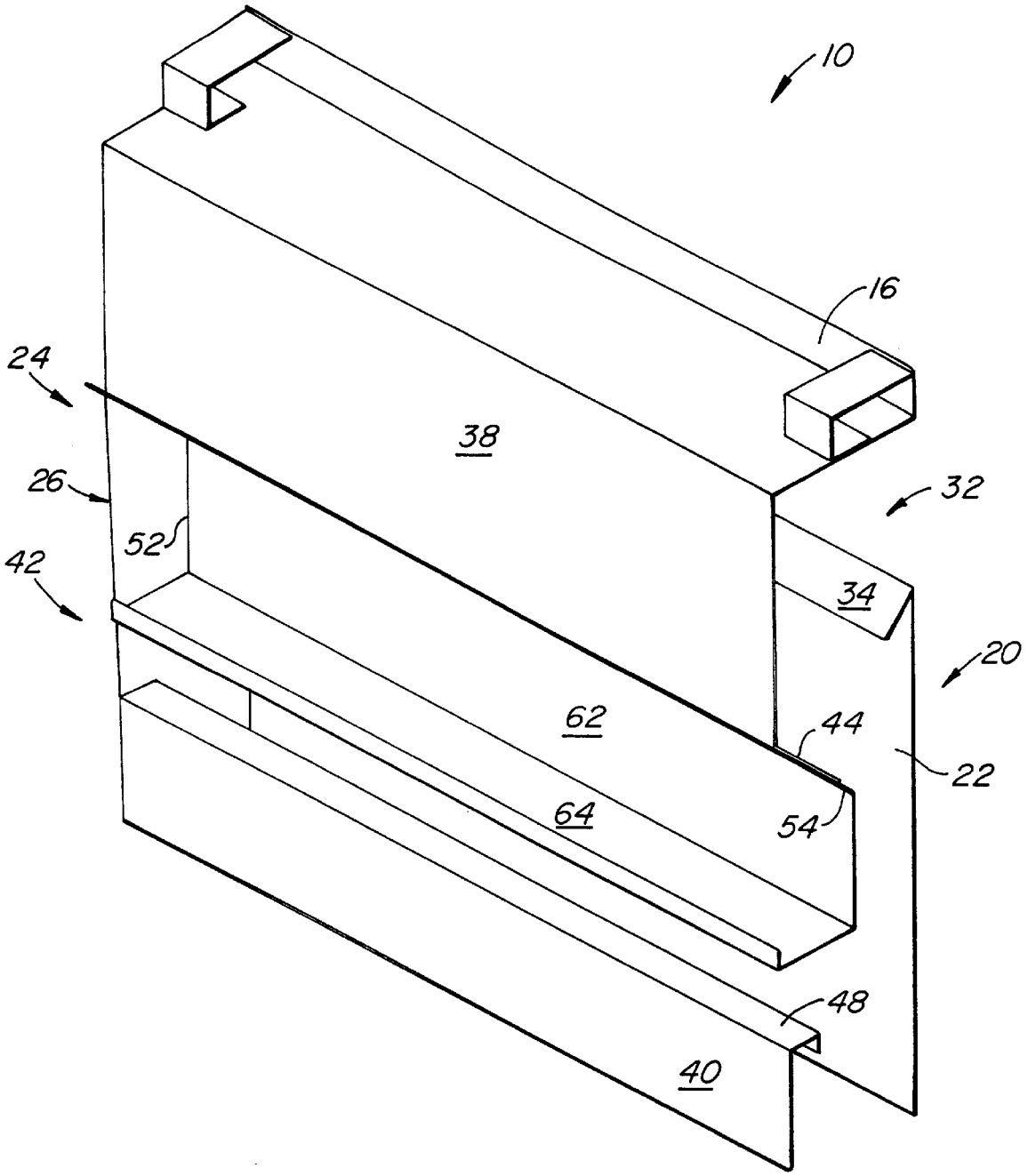
FIG. 4 is a rear perspective view of the cartridge filter of FIG. 3.
Figure 5:
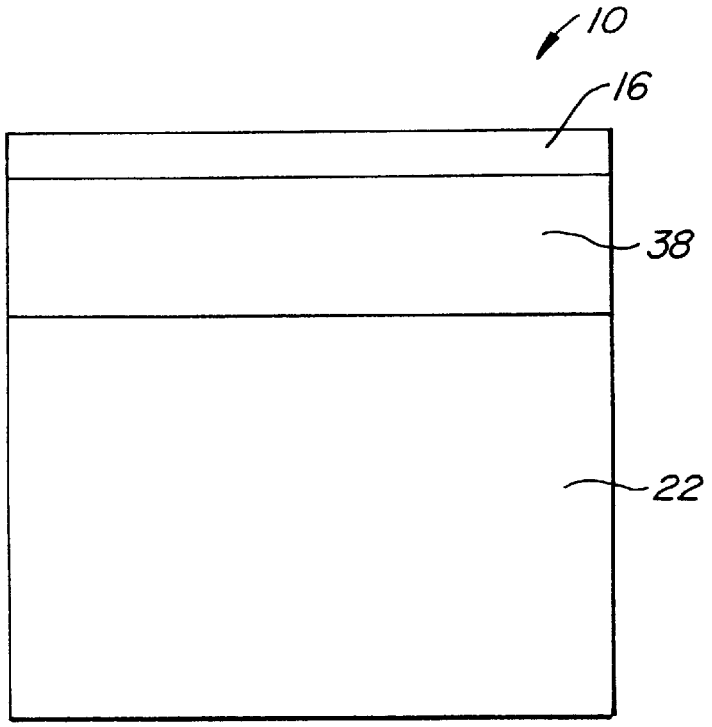
FIG. 5 is a front elevational view of the cartridge filter of FIG. 3.
Figure 6:
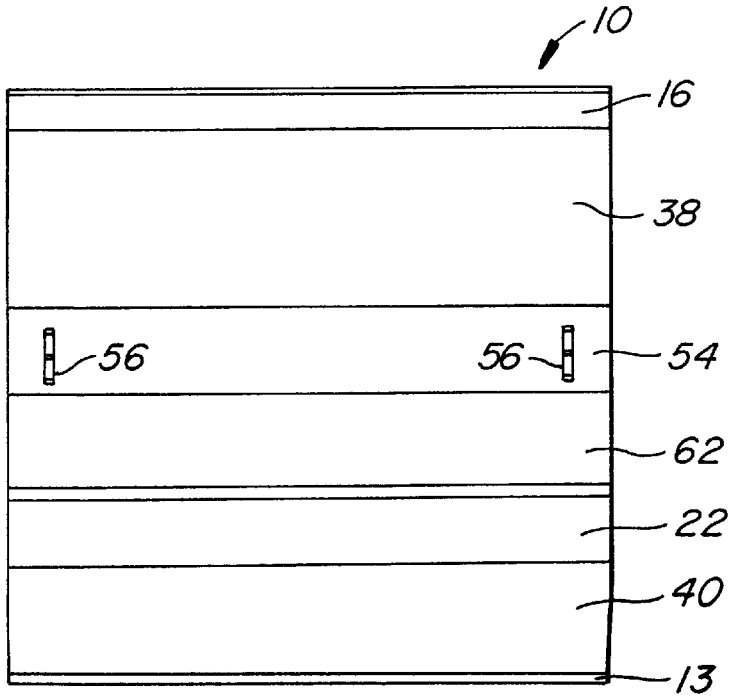
FIG. 6 is a rear elevational view of the cartridge filter of FIG. 3.

Referring to the schematic illustration of FIG. 1, a cartridge ventilation hood 8 is typically disposed above one or more cooking units (not shown). The ventilation hood 8 employs a fan (not shown) to remove the polluted air and exhaust it out of the kitchen, as generally indicated by the curved arrows. A cartridge filter 10 is disposed in the upper rear portion of the ventilator 8 to regulate the air flow through the hood 8. As seen in FIG. 1, the air enters the cartridge filter 10 from one side and exits the filter 10 on the other side in a controlled manner. A portion of the air is split from the main air flow to flow through a lower opening 13 of the cartridge filter 10, and rejoins the main air flow on the other side of the filter 10. It is noted that other arrangements are possible. A grease trough 12 is disposed below the cartridge filter 10. The lower air flow through the lower opening 13 assists in directing the grease separated from the main air flow toward the grease trough 12, as discussed in more detail below. In this embodiment, the cartridge filter 10 is inclined by about 45°, but other arrangements are possible. The partial cross-sectional view of FIG. 2 illustrates a row of the cartridge filters 10 corresponding to associated cooking units (not shown). The cartridge filter 10 rests into the slot provided in the ventilation hood 8 with the upper locking portion 16 releasably secured to the hood 8. The details of the cartridge ventilation hood 8 are generally known in the art and will not be discussed.

Referring to FIGS. 3–6, the cartridge filter 10 comprises a filter housing 20 that includes a front wall 22, a back wall 24 spaced from the front wall 22 by a wall spacing, a right wall 26 (see FIG. 4) connected between the front wall 22 and back wall 24, and a left wall 28 (see FIG. 3) connected between the front and back wall 24 and spaced from the right wall. The left wall is removed from FIG. 4 and the right wall from FIG. 3 for convenience to show the interior.

The back wall 24 is connected to the upper locking portion 16, while the upper edge of the front wall 22 is spaced from the upper locking portion 16 to define a front wall opening 32. The front wall 22 includes a front baffle 34 that is desirably inclined down. In this embodiment, the incline for the front baffle 34 is about 45°. The back wall 24 comprises an upper back wall portion 38 and a lower back wall portion 40 spaced from the upper portion by a back wall opening 42. The back wall opening 42 is desirably displaced or offset vertically relative to the front wall opening 32. The upper back wall portion 38 includes an upper back diverter 44 extending at an incline down toward the front wall 22. The incline of the upper back diverter 44 in this embodiment is about 45°. The upper back diverter 44 includes a pair of apertures 46 extending generally in the transverse direction of the longitudinal upper back diverter 44. The lower back wall portion 40 comprises a lower back baffle 48 that extends toward the front wall 22. In this embodiment, the lower back baffle 48 is relatively short and approximately perpendicular to the front wall 22.

As shown in FIGS. 3–7, the cartridge filter 10 includes an adjustable flow diverter and choke 52 disposed at the back wall opening 42 between the upper back wall portion 38 and the lower back wall portion 40. The flow diverter 52 extends at least partially through the back wall opening 42. The flow diverter 52 comprises an inclined diverter portion or guide 54 that is compatible with the inclined upper back diverter 44 of the housing 20. The inclined diverter portion 54 includes a pair of generally parallel slots 56 that correspond to the pair of apertures 46 in the upper back diverter 44, and is adjustably coupled to the upper back diverter 44 by a pair of studs or other fasteners 58 extending through the slots 56 and the apertures 46. The pair of fasteners 58 advantageously couple the flow diverter 52 to the housing 20 in a releasable manner, such that the pair of fasteners 58 may be easily loosened to change the relative positions of the flow diverter 52 to the housing 20 and refastened to secure the two members in a different configuration. The number of the fasteners 58 may vary.

The flow diverter 52 comprises a front diverter and choke portion 62 coupled to the inclined diverter portion 54 and a rear choke portion 64 coupled to the inclined diverter portion 54 through the front diverter portion 62. The front diverter portion 62 is spaced from the front wall 22 to define an adjustable front high velocity corridor 100. The rear diverter portion 64 is spaced from the lower back baffle 48 to define an adjustable rear choke spacing 101, which is equal to the back wall opening 42 minus the portion that is blocked by the flow diverter 52. In this embodiment, the front diverter and choke portion 62 is generally parallel to the front wall 22 and the rear diverter portion 64 is generally parallel to the lower back baffle 48 and generally perpendicular to the front diverter and choke portion 62.

Figure 7:
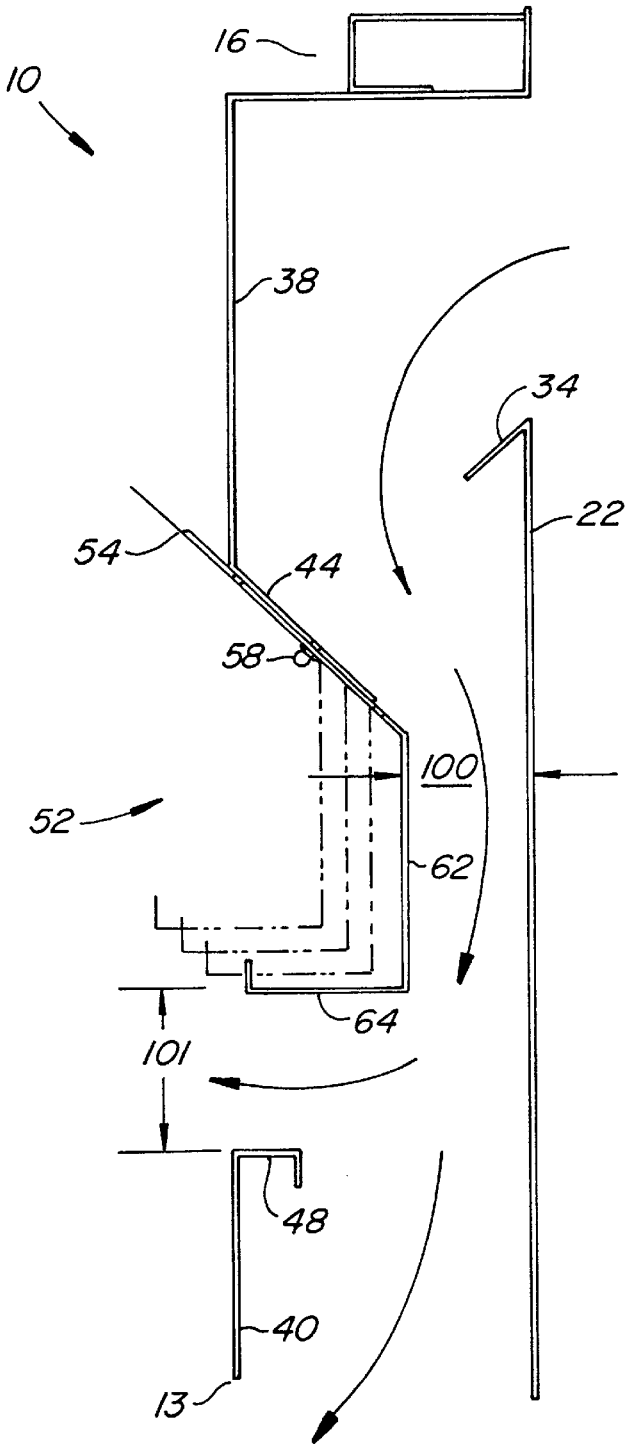
FIG. 7 is a partial cross-sectional view of the cartridge filter of FIG. 3 schematically illustrating the air flow through the cartridge filter.

The adjustment of the flow diverter 52 relative to the housing 20 is illustrated in FIG. 7, which shows different positions of the flow diverter 52. The front diverter and choke portion 62 serves as a front diverter and spacing adjustment portion that, when moved, causes a change in the front high velocity corridor 100 between the front and back walls 22, 24. The rear diverter portion 64 serves as a rear choke spacing adjustment portion that, when moved, causes a change in the spacing 101 between the rear choke portion 64 and the lower back baffle 48.

It should be kept in mind the fact that consistent exhaust fan will consistently exhaust the same volume of air until it encounters greater or lessor amounts of resistance which will respectively increase or decrease the volume of air exhausted and the fact that an exhaust fan will exhaust air from the point of least resistance.

The spacing of the choke 64 in relation to the baffle 48 and the spacing of the diverter and choke 62 in relation to the front 22 will determine the amount of resistance the exhaust fan will encounter in this cartridge. As the distance between the choke 64 and the baffle 48, or between the diverter choke 62 and the front 22, is increased or decreased, the amount of resistance the exhaust fan has to overcome is respectively increased or decreased with regard to this cartridge which is one of many within the cartridge hood of FIG. 2.

Referring to FIG. 2, if the spacing between the choke 64 and baffle 48 or between the diverter and choke 62 and the front 22 in the cartridge 10.1 is less than that of cartridges 10.2–10.8, then the exhaust fan will have to overcome greater resistance to exhaust air through cartridge 10.1, thus the exhaust fan which exhausts air from the point of least resistance will exhaust a greater amount of air through cartridges 10.2–10.8 where the resistance is less. As more air is exhausted through cartridges 10.2–10.8 this will also increase the amount of resistance to the exhaust fan. When the resistance becomes equal in all cartridges the system will balance and the new air flows through the cartridges will remain constant. The installer can readjust the choke diverter 52 at anytime to achieve the most desirable air flow segmenting for optimum exhaust and filtration.

The polluted air enters through the front wall opening 32 and encounters two immediate direction changes forced by the front baffle 34 and the rear baffle 44. These immediate direction changes start the segmenting of the heavier pollutants from the lighter air. The air flow then enters the high velocity corridor 100 formed by the diverter chock 62 and the front 22. The entire flow is sped up and then goes through a drastic turn of direction from the high velocity corridor 100 towards the rear corridor 101. The angle of turn from the high velocity corridor 100 towards the rear corridor 101 is approximately 90° in this case. Other sharp angles may be used as well. The high rate of air speed through the high velocity corridor 100 and the sudden change in direction discussed above and shown in FIG. 7 is advantageous because it facilitates grease extraction. The separated heavier pollutants are unable to follow the lighter air flow around the sudden change of direction at the end of the high velocity corridor 100, thus the momentum of the grease carries it to the bottom of the cartridge where it impinges with the cartridge, and then drains into the grease trough 12 provided in the cartridge hood. This drainage may be assisted by the lower flow through the lower opening 13 of the cartridge filter 10 as shown in FIG. 1.

Advantageously as the choke 64 and the diverter choke 62 move closer to or away from respectively the baffle 48 or the front 22 they create greater or lessor amounts of resistance to the exhaust fan in that cartridge in relation to the other cartridges of FIG. 2, thus reducing the amount of air flow through that cartridge in relation to the other cartridges. As the diverter choke 62 is moved closer to or further from the front 22, the spacing of the high velocity corridor 100 is respectively decreased or increased.

As the diverter choke 62 works to create additional resistance against the exhaust fan, it also controls the size of the high velocity corridor 100. When the choke 64 and the diverter choke 62 are used to increase the resistance to the exhaust fan relative to the other cartridges, the space between the choke 64 and the baffle 48, and between the diverter choke 62 and the front 22, is reduced, simultaneously reducing the size of the high velocity corridor 100. As a result of the increased resistance in this cartridge relative to the other cartridges, the air flow through the cartridge is reduced. As a result of the reduced space between the diverter choke 62 and the front 22, however, the air flow through the high velocity corridor 100 maintains the high rate of air speed that is required for optimum grease extraction.

The front diverted spacing 100 and rear diverted spacing 101 determine the flow pattern through the cartridge filter 10. Because of the 45° inclined coupling between the upper back diverter 44 and the inclined diverter portion 54, movement of the flow diverter 52 causes an equal displacement of the front diverter portion 62 relative to the front wall 22 and rear choke portion 64 relative to the lower back baffle 48. In this embodiment, the front diverted spacing 100 is approximately equal to the rear diverted spacing 101. It is understood that a different incline and different spacings may be used. If the incline is a degree other than 45°, the relative displacements of the front diverter portion 62 and rear diverter portion 64 will depend on the degree of incline. The adjustability of the flow diverter 52 provides a robust cartridge filter 10 that can be used in a variety of ventilation hoods for different applications without expensive and time-consuming installation. The cartridge filter 10 can be easily removed, cleaned, adjusted, and reinstalled.

A number of sample cartridge filters similar to the filter 10 described above have been tested and deemed to comply with the Standard for Grease Filters for Commercial and Institutional Kitchen Exhaust Systems, ULC-S649-93. Pairs of sample stainless steel filters measuring 510×510 mm and being 1.09 mm in thickness were installed side by side in a hood ducted to an exhaust fan. A grease generator, designed to produce an aerosol spray of preheated cooking oil, was placed on a broiler beneath the hood. The exhaust fan was adjusted to provide sufficient air flow to exhaust the vapors produced. The average air flow rate in the tests was about 1 M/s. Grease was introduced into the hood for a period of 2 hours at a rate of about 2.0 kg per hour. Following the test, the disposition of the dispensed grease was determined by weighing.

The results show that the grease collected by the filters did not fall back onto the cooking surface, and the filters did not retain significant weights of grease. It was concluded that the present filter removes a substantial percentage of airborne contaminants from cooking operations, and these contaminants are not retained in any significant quantity by the filter. The weight of grease removed from the air stream and directed to the collection trough was in excess of the standard minimum requirements of 85% under ULC-S649-93. In fact, the percentage of grease removal was consistently close to or higher than 90%, with the maximum observed percentage of about 95.3%. The grease collection of the present grease filters is exceptional.

Figure 8:
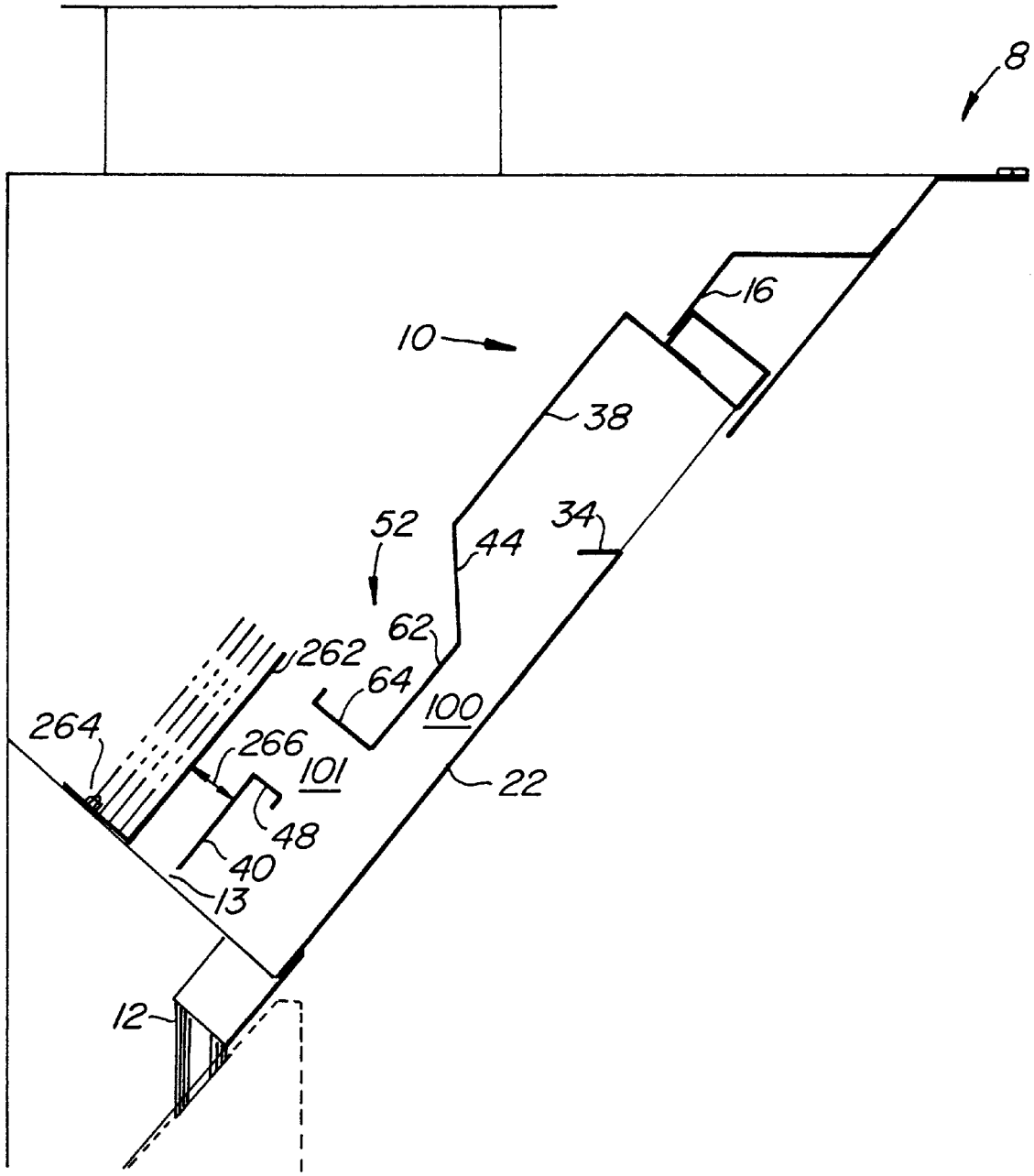
FIG. 8 is a side view of a cartridge filter installed in a cartridge ventilation hood schematically illustrating another embodiment of the invention.

Another embodiment of the invention is shown in FIG. 8, which includes the cartridge filter 10 of FIGS. 1–7 and an adjustable rear choke portion 262. In FIG. 8, the front diverter and choke portion 62 inside the cartridge filter 10 may be fixed as shown or movable as illustrated in FIG. 7. The adjustable rear choke portion 262 is disposed outside of the filter 210 about the rear diverted spacing 101. The rear choke portion 262 comprises a plate having a generally flat surface that is larger in area than the rear diverted spacing 101, and is adjustably fastened to the hood 8 with fasteners 264. The rear choke portion 262 has slots (not shown) along which the fasteners 264 may slide to adjust the position of the rear choke portion 262 relative to the rear diverted spacing 101 and lower back wall portion 40. The rear choke portion 262 is spaced from the rear diverted spacing 101 and lower back wall portion 40 by an adjustable rear choke spacing 266.

Advantageously as the rear choke portion 262 move closer to or away from the rear diverted spacing and lower back wall portion 40, it creates greater or lessor amounts of resistance to the exhaust fan in that cartridge in relation to the other cartridges of FIG. 2, thus reducing the amount of air flow through that cartridge in relation to the other cartridges. As the rear choke portion 262 is moved closer to or further from the rear diverted spacing and lower back wall portion 40, it controls the size of the rear choke spacing 266 and the flow rate through the high velocity corridor 100. When the rear choke portion 262 is used to increase the resistance on the exhaust fan relative to the other cartridges, the rear choke spacing 266 is reduced. Because of the increased resistance in this cartridge relative to the other cartridges, the air flow through the cartridge is reduced.

The above-described arrangements of apparatus and methods are merely illustrative of applications of the principles of this invention and many other embodiments and modifications may be made without departing from the spirit and scope of the invention as defined in the claims.

What is claimed is:

1. An adjustable cartridge filter for use in a cartridge ventilator, the cartridge filter comprising:

a filter housing including a front wall having a front wall opening and a back wall coupled to and spaced from the front wall and having a back wall opening; and a flow diverter disposed obstructively at the back wall opening and being adjustably supported by the housing to move relative to the back wall and front wall, the flow diverter having a front diverter portion spaced from the front wall to define an adjustable front diverted spacing, the flow diverter having a rear choke portion coupled to the front diverter portion and blocking a portion of the back wall opening to define an adjustable rear diverted spacing equal to a remaining portion of the back wall opening not blocked by the rear choke portion.

2. The cartridge filter of claim 1, wherein the front wall and back wall are generally parallel.

3. The cartridge filter of claim 2, wherein the front diverter portion of the flow diverter is generally parallel to the front wall, and the rear choke portion is generally perpendicular to the back wall.

4. The cartridge filter of claim 1, wherein the front wall further comprises a front baffle at a boundary of the front wall opening, wherein the front baffle extends partly toward the flow diverter.

5. The cartridge filter of claim 1, wherein the back wall comprises a first back baffle at a first boundary of the back wall opening, and the first back baffle is spaced from the rear choke portion of the flow diverter to define the adjustable rear diverted spacing.

6. The cartridge filter of claim 5, wherein the back wall comprises a second back baffle extending from a second boundary of the back wall opening at an incline relative to the back wall.

7. The cartridge filter of claim 6, wherein the flow diverter comprises an inclined diverter portion that is coupled to the front diverter portion and adjustably coupled to the second back baffle.

8. The cartridge filter of claim 6, wherein the second back baffle is inclined by about 45 degrees.

9. The cartridge filter of claim 1, wherein the adjustable front diverted spacing and the adjustable rear diverted spacing are approximately equal.

10. The cartridge filter of claim 1, further comprising a rear choke portion disposed about the filter housing and spaced from the back wall of the filter housing and from the rear diverted spacing.

11. The cartridge filter of claim 10, wherein the rear choke portion is adjustably mounted with respect to the filter housing and spaced from the rear diverted spacing by an adjustable rear choke spacing.

12. The cartridge filter of claim 10, wherein the rear choke portion comprises a generally flat surface that is larger in area than the rear diverted spacing.

13. An adjustable cartridge filter for use in a cartridge ventilator, the cartridge filter comprising:

a front wall having a front wall opening;

a back wall coupled to and spaced from the front wall by a wall spacing and having a back wall opening with a boundary;

a flow diverter and choke including a wall spacing adjustment portion coupled with a back wall opening adjustment portion; and means for movably coupling the flow diverter to the back wall to adjust the wall spacing adjustment portion relative to the front wall to change the size of the wall spacing and to adjust the back wall opening adjustment portion relative to the boundary of the back wall opening to change the size of the back wall opening.

14. The cartridge filter of claim 13, wherein the means comprises an inclined baffle coupled to the back wall and an inclined guide coupled to the flow diverter and movably coupled to the inclined baffle to adjust the sizes of the wall spacing and back wall opening.

15. The cartridge filter of claim 14, wherein the inclined guide comprises a plurality of apertures and the inclined baffle comprises a plurality of slots that are movably coupled to the plurality of apertures with releasable fasteners.

16. The cartridge filter of claim 13, wherein the size of the wall spacing and the size of the back wall opening are approximately equal.

17. The cartridge filter of claim 16, wherein the inclined guide and inclined baffle are movably coupled to change the sizes of the wall spacing and back wall opening by approximately equal amounts.

18. The cartridge filter of claim 13, further comprising a rear choke portion spaced from the back wall and adjustably mounted to move with respect to the back wall and the back wall opening.

19. A cartridge ventilator comprising:

a ventilator hood;

a cartridge filter housed in the ventilator hood, the cartridge filter comprising a filter housing including a front wall having a front wall opening and a back wall coupled to and spaced from the front wall and having a back wall opening, the cartridge filter further comprising a flow diverter disposed obstructively at the back wall opening and having a front diverter portion spaced from the front wall to define a front diverted spacing, the flow diverter having a rear choke portion coupled to the front diverter and blocking a portion of the back wall opening to define a rear diverted spacing equal to a remaining portion of the back wall opening not blocked by the rear choke portion; and a rear choke portion coupled to the ventilation hood and obstructively spaced from the rear diverted spacing.

20. The cartridge ventilator of claim 19, wherein the rear choke portion comprises a generally flat surface being larger in area than the rear diverted spacing.

21. The cartridge ventilator of claim 19, wherein the rear choke portion is adjustably coupled to the ventilation hood to move relative to the back wall and rear diverted spacing.

22. The cartridge ventilator of claim 21, wherein the rear choke portion comprises at least one slot through which a fastener extends and slidably attaches the rear choke portion to the ventilation hood.

23. The cartridge ventilator of claim 19, wherein the flow diverter is adjustably supported by the filter housing to adjust the front diverted spacing and rear diverted spacing.

* * * * *